US005940576A

United States Patent [19]

de Simon

[11] Patent Number: 5,940,576

[45] Date of Patent: Aug. 17, 1999

[54] ELECTRONIC CONTROL UNIT FOR A VACUUM PUMP

[75] Inventor: Mauro de Simon, Osoppo, Italy

[73] Assignee: Varian, Inc., Palo Alto, Calif.

[21] Appl. No.: 08/946,430

[22] Filed: Oct. 7, 1997

[30] Foreign Application Priority Data

Oct. 8, 1996 [IT] Italy ..... TO96 A0822

[51] Int. Cl.[6] ..... H02P 5/17

[52] U.S. Cl. ..... 388/811; 318/254; 318/727; 318/811; 417/3; 415/90

[58] Field of Search ..... 318/254, 811, 318/727; 417/3, 423.4, 423.14, 423.15, 27

[56] References Cited

U.S. PATENT DOCUMENTS

| | | | |
|---|---|---|---|
| 4,327,315 | 4/1982 | Kawada et al. | 318/811 |
| 4,897,023 | 1/1990 | Bingler | 417/423.15 |
| 5,238,362 | 8/1993 | Casaro et al. | 415/90 |
| 5,443,368 | 8/1995 | Weeks et al. | 417/27 |
| 5,444,350 | 8/1995 | Werle et al. | 318/727 |
| 5,674,051 | 10/1997 | Maruyama | 417/3 |

*Primary Examiner*—William M. Shoop, Jr.
*Assistant Examiner*—Rita Leykin
*Attorney, Agent, or Firm*—Bella Fishman

[57] ABSTRACT

The invention is concerned with an electronic control unit (1) for the electric motor of a vacuum pump (100) comprising a suction port (119), an exhaust port (120) and pumping stages formed by rotor disks (113, 114) secured to a rotating shaft driven by an electric motor, and stator rings (115, 116) secured to a pump housing (101) and cooperating with said rotor disks. The unit (1) comprises: a housing (2), first leads (50) for electrically feeding the control unit, second leads (60) for electrically feeding the motor of the pump (100), a circuit for generating a voltage adapted to feed the motor, the circuit generating drive signals (A, B, D, E, G, H, PWM) and providing at least a pulsating signal (PWM the width of which for combining said drive signals can be modulated, and means (201, 202, 203) for combining the, pulsating signal (PWM) with at least one of the drive signals (A, D, G) so as to change the rms voltage of said voltage system.

14 Claims, 12 Drawing Sheets

ELECTRONIC CONTROL UNIT FOR A VACUUM PUMP

BACKGROUND OF THE INVENTION

The present invention relates to a control unit or controller for a vacuum pump, particularly for a vacuum pump of the turbomolecular type.

As it is known in the art, a turbomolecular vacuum pump comprises a plurality of pumping stages housed within a substantially cylindrical casing and provided with an axial inlet port of the sucked gases located at one end, and with a radial or axial exhaust port of the gases located at the opposed end.

The pumping stages generally comprise a rotor disk, secured to the rotatable shaft of the pump, that is driven by an electric motor at a speed usually not lower than 25,000 rpm and in some cases as high as 100,000 rpm.

The rotor disk rotates within stator rings fastened to the pump casing and defining the stator of the pumping stage, with a very small gap therebetween.

In the space between a rotor disk and the associated stator disk a pumping channel of the sucked gases is further defined.

The pumping channel defined between the rotor and the stator in each pumping stage communicates with the preceding and the subsequent pumping stages through a suction port and an exhaust port, respectively, provided through the stator in correspondence of the pumping channel of the sucked gases.

A turbomolecular pump of the above type is disclosed for example in U.S. Pat. No. 5,238,362 assigned to the Assignee of the present invention.

The turbomolecular pump described in U.S. Pat. No. 5,238,362 employs both pumping stages provided with rotors formed as flat disks and pumping stages provided with rotors equipped with blades.

This combined arrangement of pumping stages allows for a very good performance of the pump for what concerns the compression ratio, while allowing to discharge the gases into the outer environment at atmospheric pressure by means of simple pre-vacuum pumps without lubricant, such as diaphragm pumps.

Moreover, the construction of the vacuum pump of the turbomolecular type as taught by U.S. Pat. No. 5,238,362 allows for a considerable reduction of the pump power consumption.

It is further known to employ electronic control units or controllers for feeding the motor of a vacuum pump in general, and more particularly of the turbomolecular type, equipped with a transformer for converting the available AC mains voltage into the rated voltage level suitable for the operation of the vacuum pump.

Because of the overall size and the cooling requirements mainly caused by the presence of the transformer, the known unit must be mounted separately from the turbomolecular pump and be provided with dedicated cooling devices in addition to those already provided for cooling the pump.

Namely the presence of a transformer in the known control units not only increases the unit size, thus preventing the construction of a compact device that could be integrated with the pump into a single pumping apparatus, but further creates an additional heat source that raises the temperature of the control unit and of the circuitry forming such unit.

In accordance with the known art, this implies the provision of a control unit separated from the vacuum pump, to be independently cooled and electrically connected both to the mains and to the vacuum pump by conductors of suitable lengths and cross sections.

In the field of the vacuum pumps it is further known that the feeding voltage level must be changed during the operating cycle on the basis of the residual pressure within the vacuum pump and the operating conditions of the pump motor from the starting condition to the steady state rotating condition.

Since the feeding voltage level of a turbomolecular pump effects the pumping speed at which the gases are pumped, there have been designed control units of the above described type for vacuum pumps, capable of supplying the vacuum pump with a plurality of voltages that are selected as a function of the pump current, and therefore as a function of the pressure level inside the pump.

In such control units the voltage applied to the motor of the pump can be adjusted, for example through an SCR or a TRIAC controlled rectifying bridge.

On the other hand the voltage level of the mains can be varied, for example, through a transformer having a primary winding divided into a number of sections that are connected to as many switch contacts.

SUMMARY OF THE INVENTION

The object of the present invention is to realize a compact control unit for vacuum pumps, more particularly of the turbomolecular type, capable of varying the feeding voltage level supplied to the pump motor, and capable of accommodating substantially all the voltages commonly available on the public power distribution networks.

This object of the present invention is accomplished through a control unit comprising a casing with plurality of leads for electrically feeding the control unit itself and for electrically feeding the electric motor of the vacuum pump control unit comprising a circuit for generating a voltage system for feeding said electric motor of the vacuum pump under control of a plurality of drive signals including at least one pulsating signal, the pulse width of said pulsating signal can be modulated, the circuit comprising means for combining at least one pulsating signal with at least one of the drive signals in the circuit. The combining means modifies the rms voltage of at least one voltage of the voltage system proportionally to the width of the modulated pulsating signal.

The electronic control unit of the present invention can be utilized for vacuum pumps having polyphase asynchronous, D.C. "brushless" or switched reluctance types of motors.

The electronic control unit of the present invention may be successfully used in a turbomolecular vacuum pump provided with a suction port, an exhaust port and a plurality of pumping stages formed by rotor disks secured to a pump rotating shaft driven by the electric motor of the type mentioned above, and stator rings secured to a pump body and cooperating with the rotor disks.

Further characteristics and advantages of the invention will become evident from the description of a preferred exemplary but not limiting embodiment of a control unit for a vacuum pump illustrated in the attached drawings.

DESCRIPTION OF THE PREFERRED EMBODIMENTS

The basic concept exploited by the present invention to regulate the voltage supplied to the electric motor of a vacuum pump is that of providing means for periodically interrupting the drive signals in the feeding circuit of the vacuum pump motor in such a way as to modify the rms (root mean squared) value of at least one of the e.m.f.s. (electromotive forces) forming the e.m.f. or voltage system generated by the control unit and feeding the motor.

Since the rms value of a voltage is inversely proportional to the duration of the switched-off intervals, such rms value can be modified in a wide range by properly adjusting the duration of the switching intervals.

Therefore the effect that can be obtained on the motor working is similar to the effect that could be achieved through more complex direct regulation of the voltage values.

In a preferred embodiment in which the vacuum pump is equipped with a three-phase A.C. asynchronous motor, the three-phase system of square-wave voltages for feeding the motor of the vacuum pump is generated by the circuit disclosed in details hereinbelow with reference to FIGS. 1, 2*a*, 2*b* and 3*a* through 3*g*.

Figure 1:
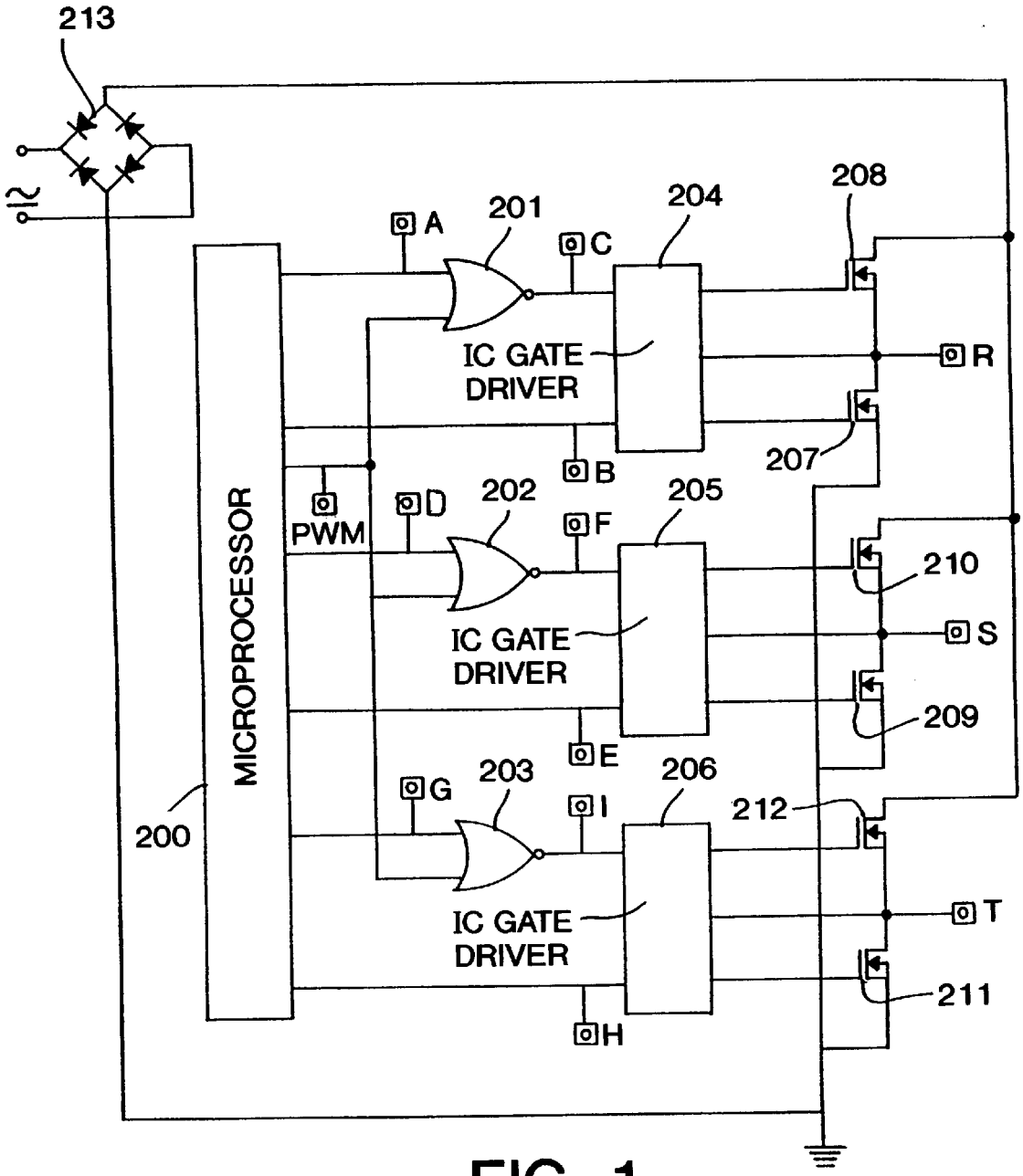
FIG. 1 shows a block diagram of the electronic circuit used in a control unit of the present invention.

The circuit illustrated in FIG. 1 substantially comprise a microprocessor 200 connected to three NOR gates 201, 202 and 203, three IC gate drivers 204, 205 and 206 each having one input connected to the microprocessor 200 and the other to the output of one of the above NOR gates, three pairs of transistors, e.g. of the MOSFET type, indicated by the references from 207 to 212. The two MOSFET transistors of each pair are connected in series with each other, with both the two transistor gates and the common junction terminals R, S and T of the series connection connected to as many outputs of the corresponding NOR gate. For each transistor pair one of the remaining terminals (the source of transistor 208 in FIG. 1) is connected to a D.C. supply voltage while the other (the drain of transistor 207) is grounded. The D.C. voltage is obtained through a diode bridge 213 properly connected to the mains.

Through the diode bridge 213 the alternating current from the mains is rectified and directly applied, i.e. without any intermediate voltage regulator, across the series connection of each pair of the six MOSFET transistors 207 through 212 shown in FIG. 1.

Under the control of the gate drivers 204, 205, 206 each of the pairs of MOSFET transistors 207 to 212 generates one of the voltages of a three-phase system to feed the three-phase asynchronous motor of the vacuum pump.

FIG. 2 illustrates the signals A, B, D, E, G, H, generated by microprocessor 200 for driving the MOSFET transistors 207 to 212 through the gate drivers 204, 205 and 206. In the circuit of FIG. 1 the terminals on which such signals are present and are labeled with the same reference numbers as the corresponding signals.

Signals B, E and H, are shown as negative since they relate to "low" inputs of the gate drivers 204, 205 and 206 for driving those of the MOSFET transistors having a terminal connected to ground.

The frequency of said signals A, B, D, E, G and H, corresponds to the excitation frequency of the asynchronous motor driving the vacuum pump.

The microprocessor 200 further generates a PWM signal, formed by pulses having a constant frequency and duration capable of being modulated, which signal is applied to the second input of each NOR gates 201, 202 and 203 for intermittently enabling (opening and closing) such NOR gates.

Figures 2A, 2B:
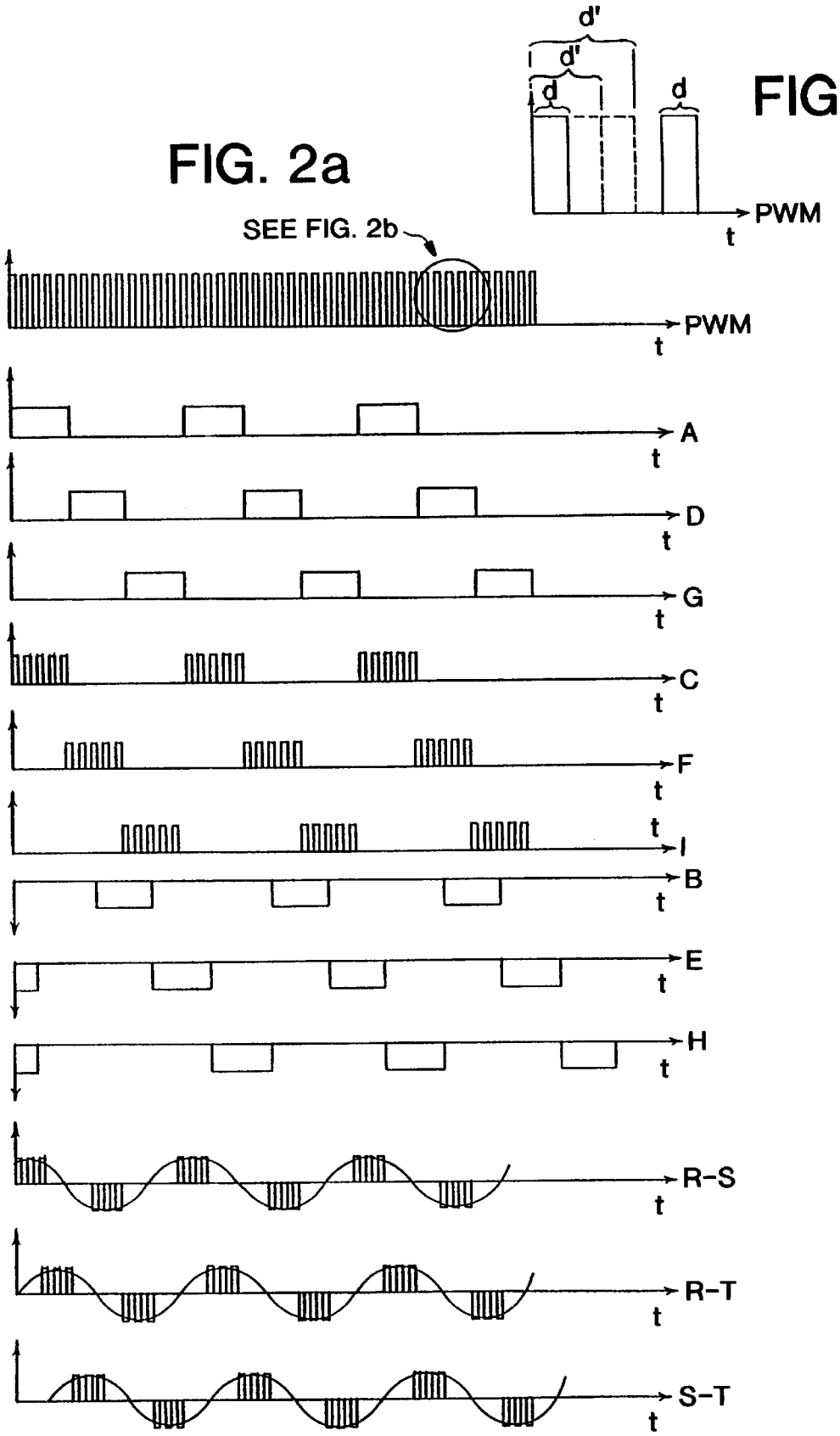
FIG. 2*a* and 2*b* are diagrams showing some of the theoretical waveforms in the circuit of FIG. 1.

The enlarged detailed view of FIG. 2*b* illustrates the widths or durations of said PWM signal when modulated by pulses having widths d, d' or d", respectively.

Each of the waveforms C, F and I in FIG. 2*a* show the signals at the outputs of NOR gates 201, 202 and 203, respectively, generated by the above intermittent opening and closing of the NOR gates by the pulsating PWM, i.e. the NORings of PWM signal with signals A, D and G, respectively.

As shown in FIG. 2*a* the signals C, F and I are intermittent, i.e. formed by spaced bursts or trains of pulses with the duration of the burst corresponding to the time the signals A, D or G respectively is high, and the spacing to the time for which such signals are low. Signals C, F and I are applied to one input of the gate drivers 204, 205 and 206, and generates outputs used for driving those (208, 210, 212) of the MOSFET transistors that are not connected to ground.

This way between each pair of terminals R-S, S-T and T-R there will be generated the square wave signals C, F and I of FIG. 2*a*, respectively, that are out of phase by 120° from each other and intermittent, i.e. formed by spaced bursts or trains of pulses with the duration of the burst corresponding to the time the signals A, D or G respectively is high, and the spacing to the time for which such signals are low. Signals C, F and I are applied to one input of the gate drivers 204, 205 and 206, and generates outputs used for driving those (208, 210, 212) of the MOSFET transistors that are not connected to ground. The so generated voltage system is a three-phase system of square wave voltages in which the voltage level is periodically zeroed for an interval the duration of which depends on the PWM signal.

Therefore the rms voltage of said three-phase voltage system will be proportional to the pulse width of the PWM signal generated by the microprocessor 200.

The frequency of the PWM signal is generally selected in the range between 5 and 20 times the excitation frequency of the asynchronous motor.

Since the power dissipated in the MOSFET transistors 207 to 212 mainly depends on the number of their ON/OFF switchings, and since it is sufficient to cut off only one MOSFET transistor in each pair of MOSFET transistors 207 to 212 to block the flow of the feeding current to each of the terminals R, S and T, in order to reduce the heat generation, then the pulsating signal PWM is combined only with the signals driving one transistor of each pair of the MOSFET transistors 207 to 212.

A voltage duplicating device can be provided in the network feeding line for extending the working range of the electronic control unit from about 90 to 260 V a.c.

Therefore, by selecting an asynchronous motor capable of supplying the rated power at about 180 V a.c., it is possible to accommodate variations of the power distributing network voltage and to appreciably increase the efficiency of the electric motor with respect to the traditional low voltage motors, typically working at 50 V a.c.

FIGS. 3*a* through 3*g* show the real waveforms of some of the most significant signals in the circuit of FIG. 1 at different rotation speeds of an asynchronous motor driving the vacuum pump.

Figure 3A:
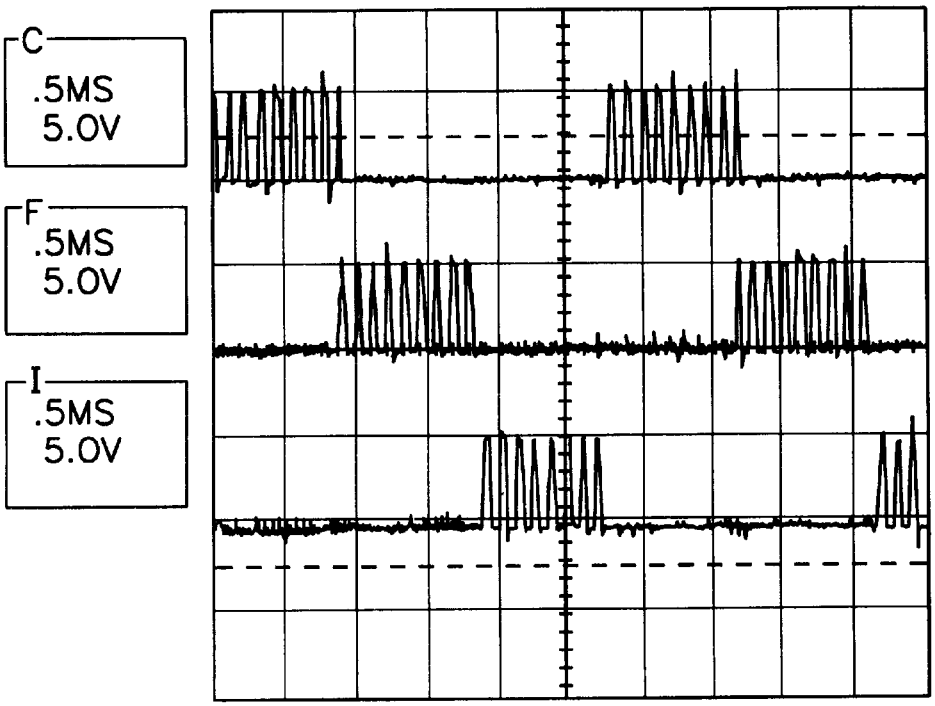
FIGS. 3*a* through 3*g* show the experimental waveforms of some signals in the circuit of FIG. 1.
Figure 3B:
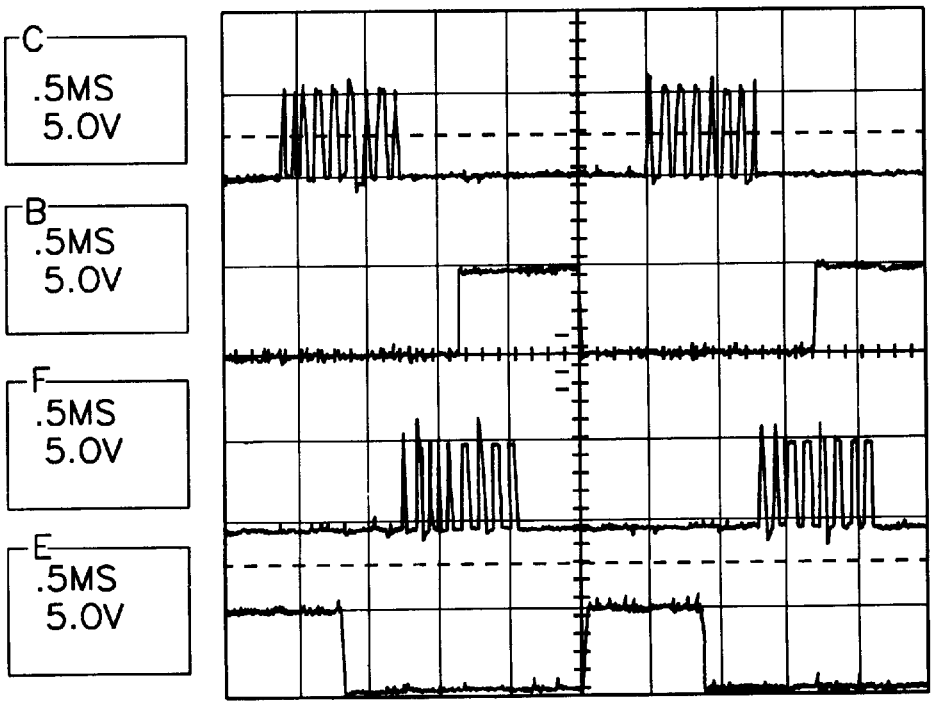
Figure 3C:
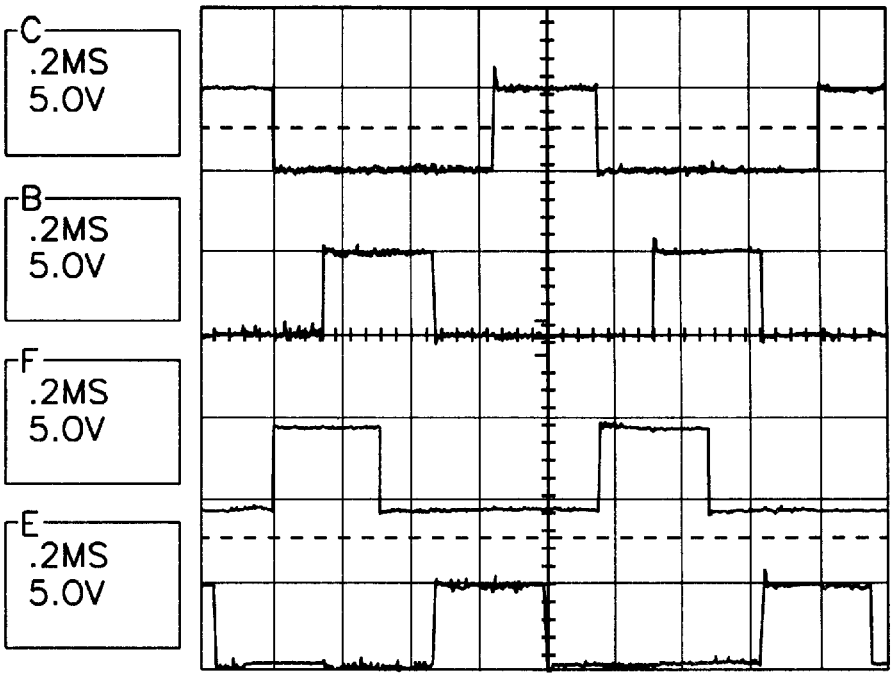
Figure 3D:
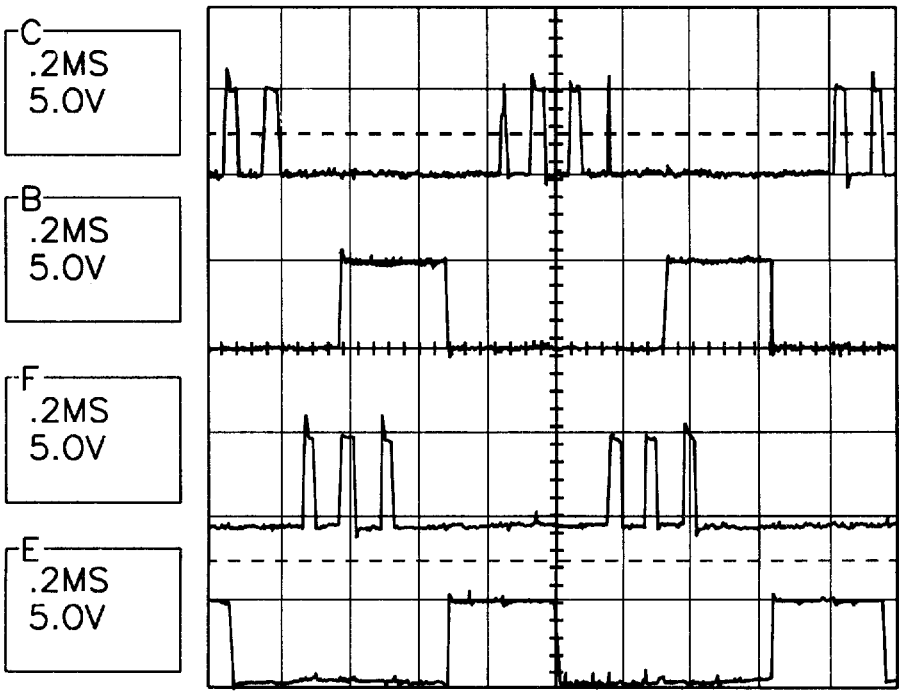
Figure 3E:
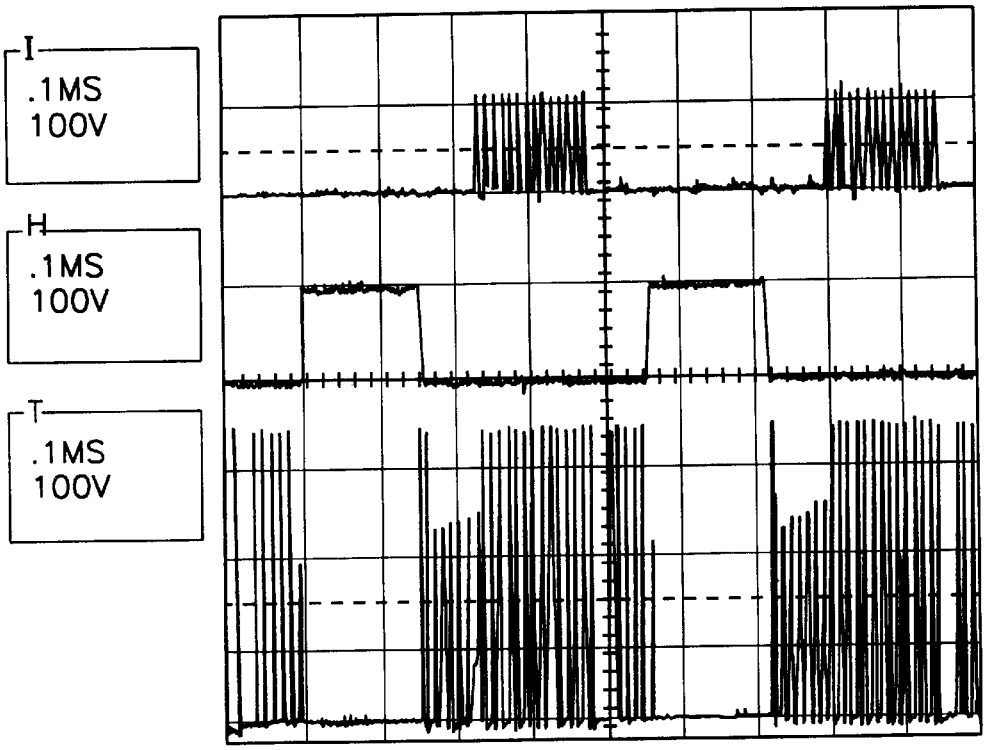
Figure 3F:
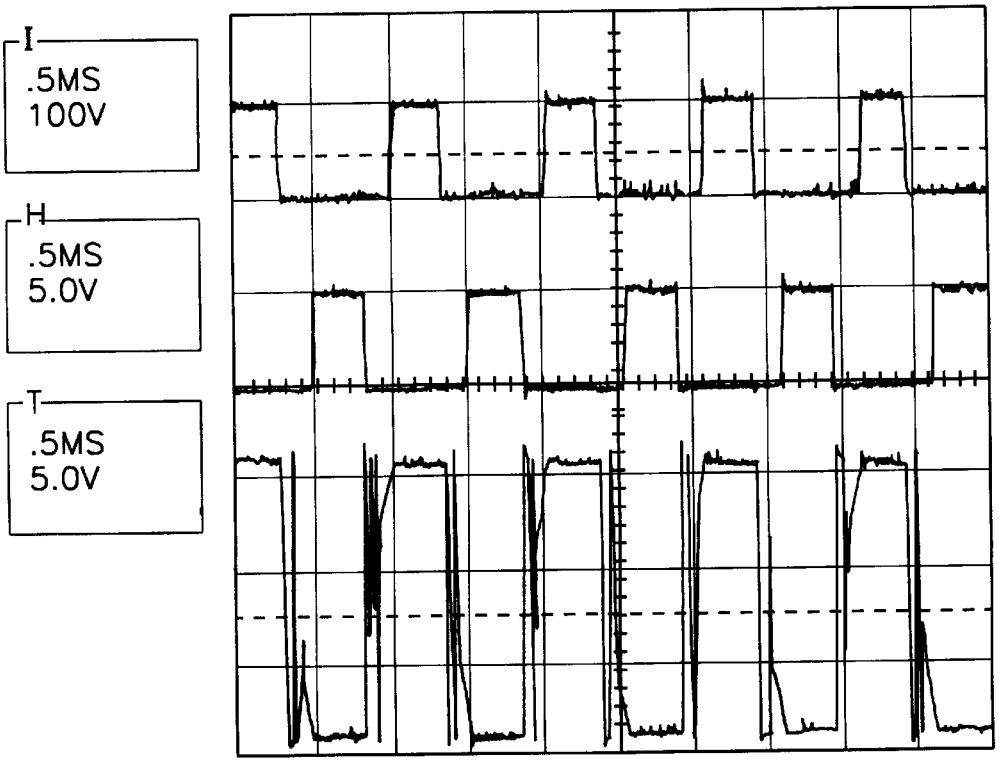
Figure 3G:
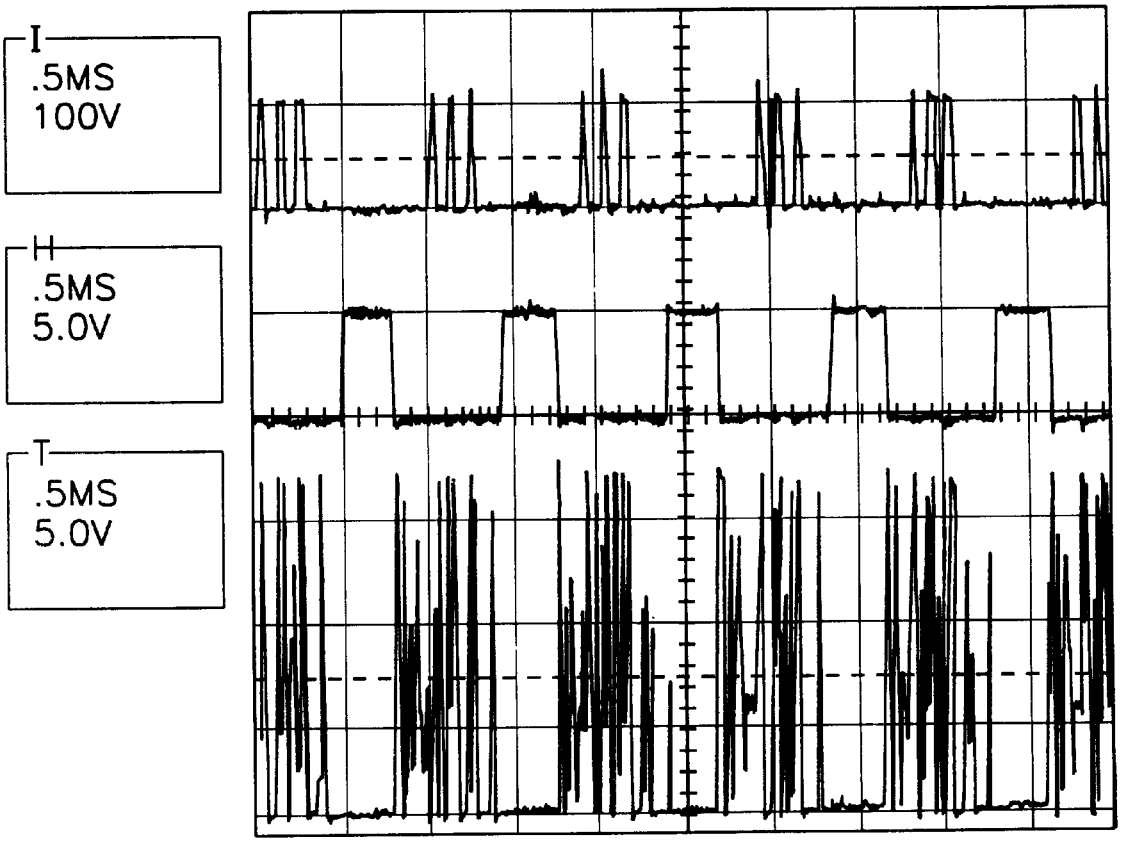
Figure 4:
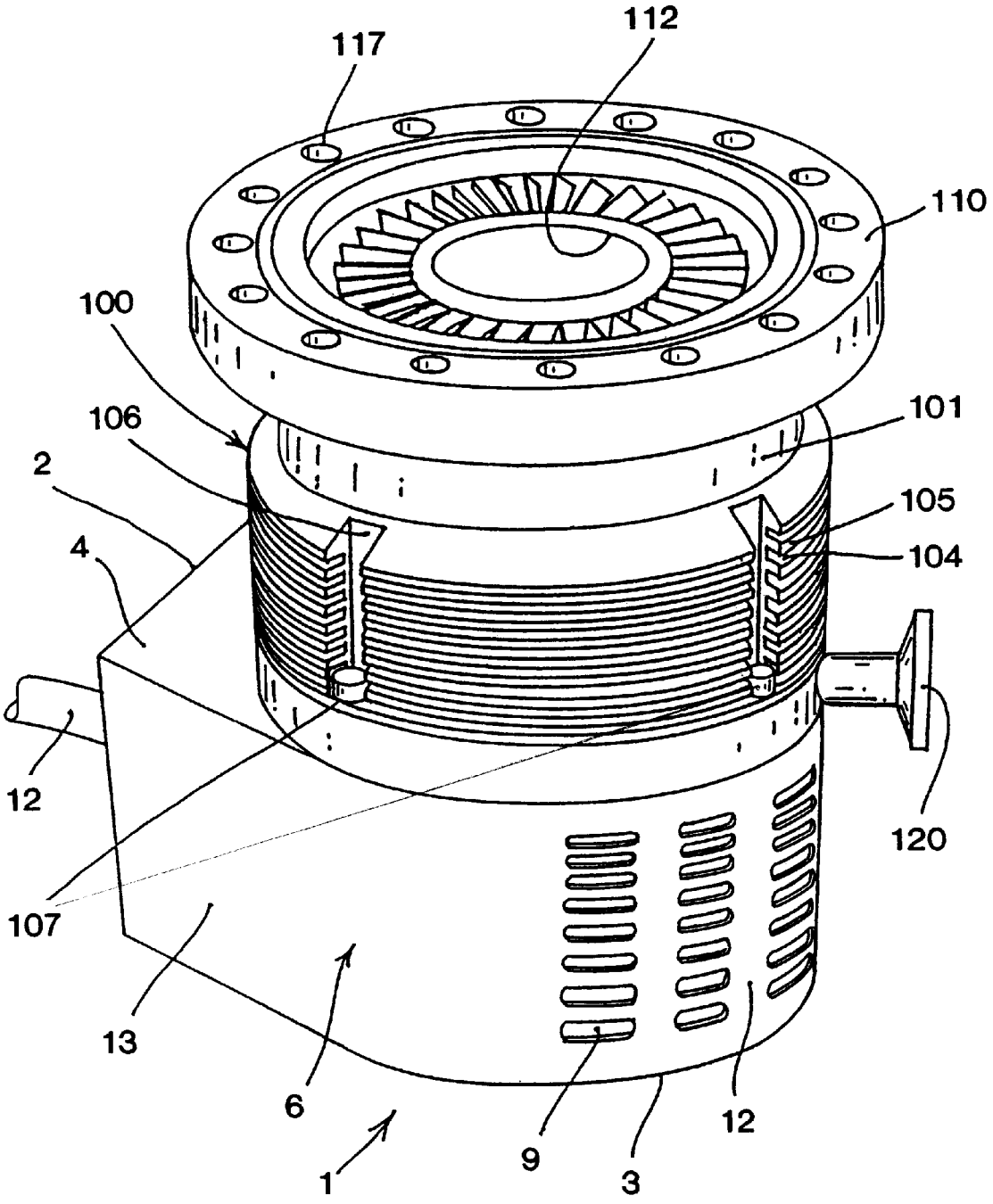
FIG. 4 is a front perspective view of an electronic control unit according to the present invention, integrated into a turbomolecular vacuum pump.
Figure 5:
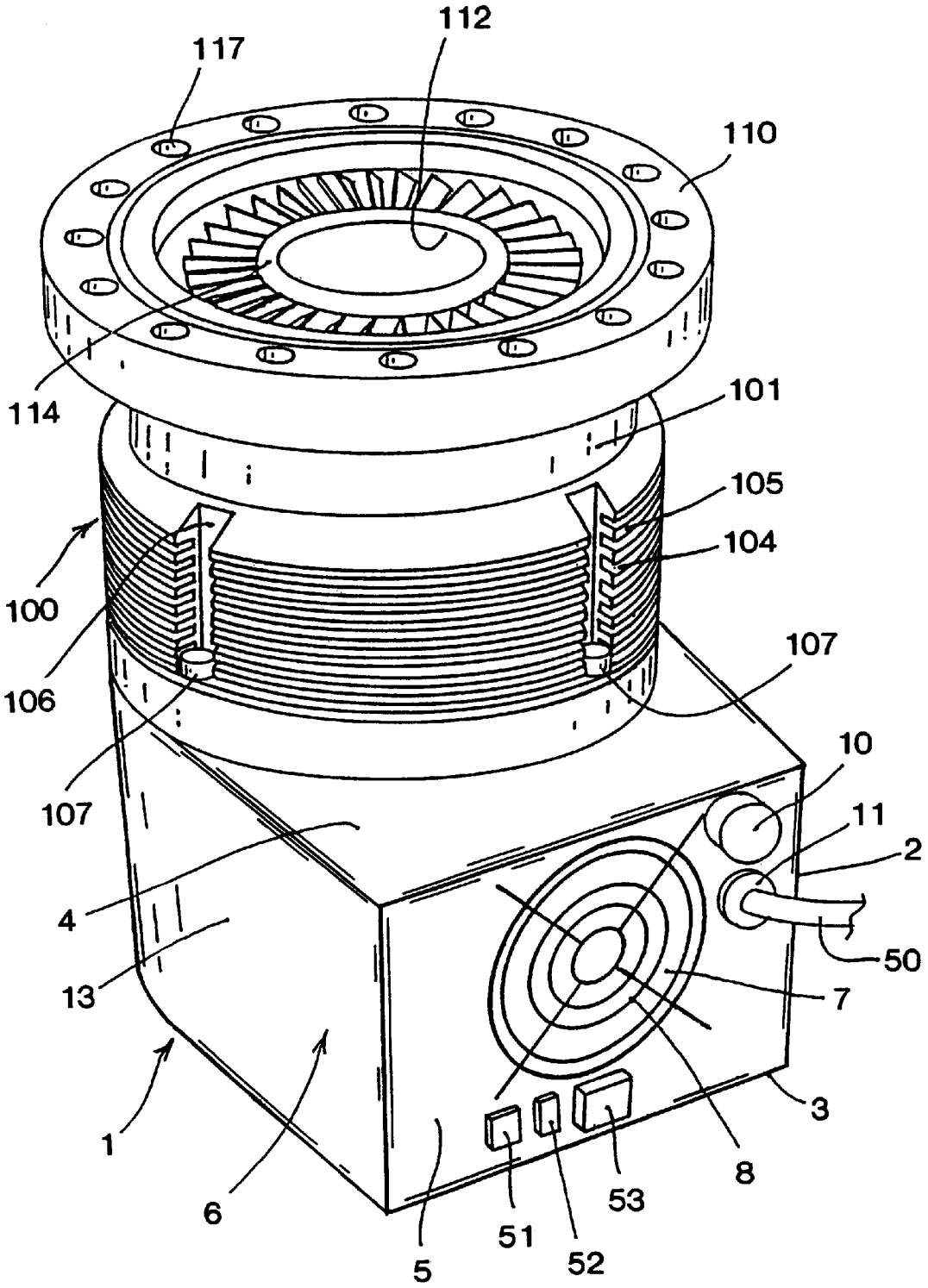
FIG. 5 is a rear perspective view of the integrated electronic control unit of FIG. 4.
Figure 6:
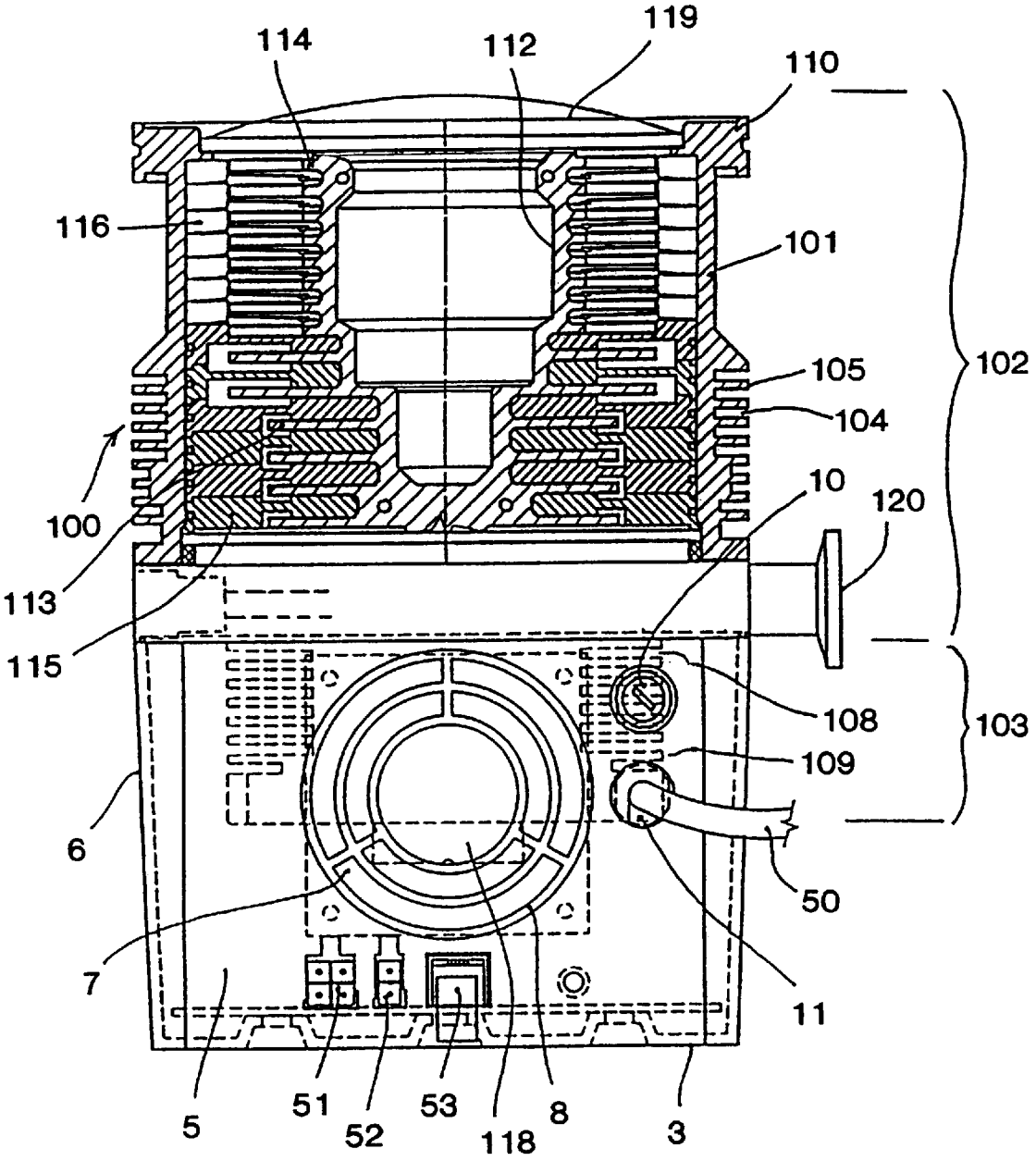
FIG. 6 is a partially cross sectioned rear view of the integrated unit illustrated in FIGS. 4 and 5.

More particularly, FIG. 3*a* relates to a steady state rotation of the vacuum pump motor at 21,000 rpm, FIG. 3*b* to a stead state rotation at 24,000 rpm, FIG. 3*c* to a steady state rotation at 62,000 rpm, FIG. 3*d* to a steady state rotation at 62,000 rpm, FIG. 3*e* to a steady state rotation at 13,000 rpm, FIG. 3*f* to a steady state rotation at 60,000 rpm and FIG. 3*g* to a steady state rotation at 62,000 rpm.

Advantageously the above described circuit can be equipped with means that are known to one skilled in the art for other types of motors that drive vacuum pumps, such as for example motors of the "brushless" type (without brushes) or "switched reluctance" (S.R.) motors.

When using "brushless" and S.R. motors, the frequency of the PWM signal must vary as a function of the rotor position and therefore a return signal has to be provided that contains information relating to the rotor position in the motor.

This signal is processed by the microprocessor 200 and supplied, for example, to an optical or magnetic position sensor provided in the motor (not shown in the drawings).

The principle exploited in the above illustrated preferred embodiment—based on the presence of the PWM pulsating signal to activate and deactivate at least one of the motor driving signals—can be used with advantage also in different arrangements that are easily conceivable by the average skilled in the art.

As an example, a first alternative embodiment of the control unit of the present invention can generate the voltage system and regulate the feeding voltage by using a small insulating transformer fed by the network voltage that has been rectified and modulated at high frequency, typically 100 kHz, with a mean value equal to zero. The voltage across the secondary winding of such small transformer is rectified again, filtered and used to drive transistors that feed the vacuum pump motor. The value of the motor drive voltage can be regulated by varying the rms voltage of the high frequency signal feeding the primary winding of the small transformer through the combination of a PWM signal in accordance with the principle described in the preferred embodiment.

In this second embodiment the dimensions of the transformer can be reduced to a minimum since the operating frequency is high.

In accordance with a further alternative embodiment of the control unit of the present invention, the voltage system and the regulation of the feeding voltage are accomplished through an L-C filtering group with a recirculation diode fed by the distribution network voltage that has been rectified and modulated at high frequency with a mean value different from zero.

The regulation of the drive voltage for the motor is obtained by varying the "duty cycle" of the high frequency voltage applied the L-C filtering group through the combination of a PWM signal in accordance with the principle described in the preferred embodiment.

With reference to FIGS. 4 to 9, the electronic control unit of the present invention, indicated as a whole by reference 1, is integrated in a turbomolecular pump, indicated as a whole by reference 100.

Figure 9:
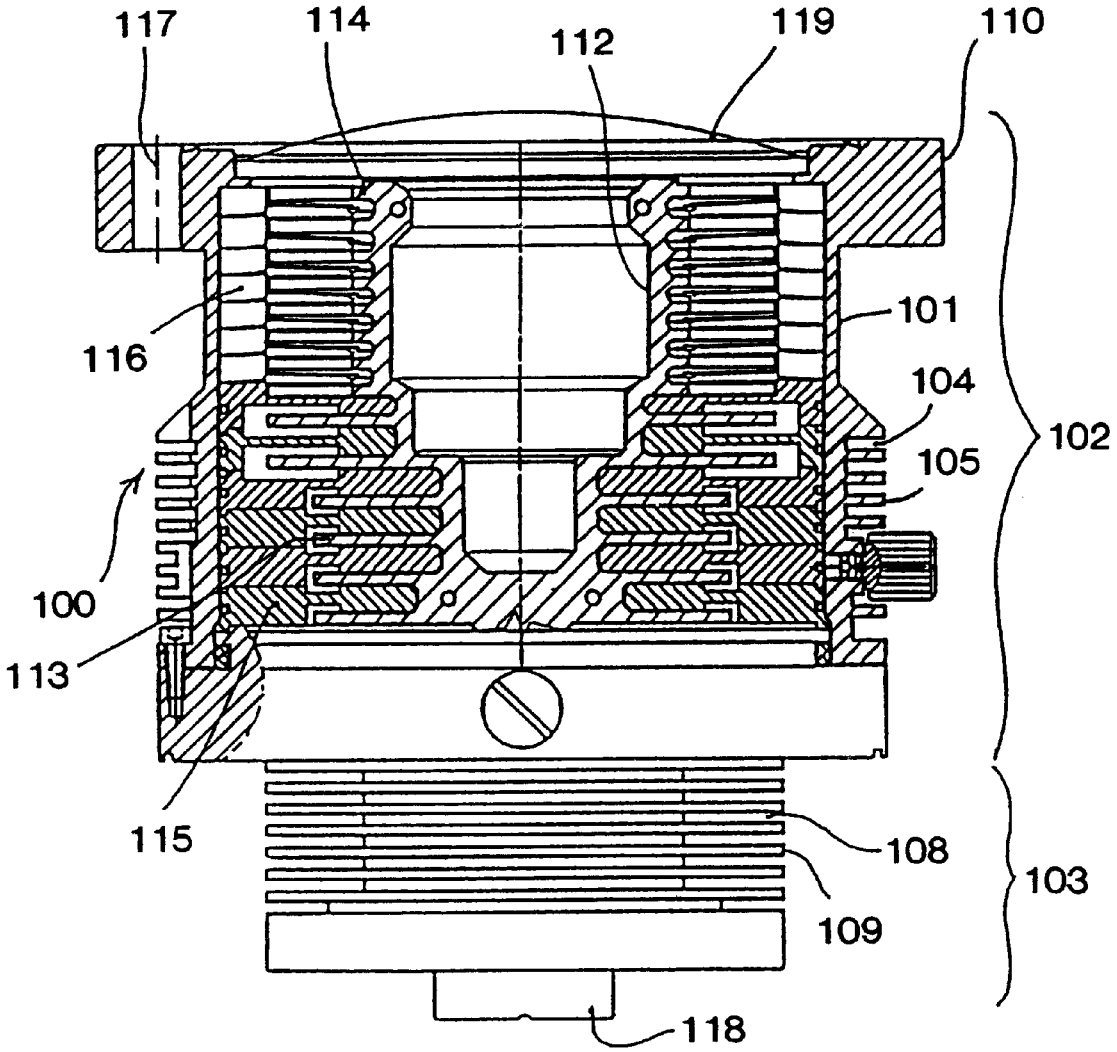
FIG. 9 is a partially cross sectioned view of the turbomolecular pump illustrated in FIGS. 4 to 6.

As better shown in FIG. 9, the turbomolecular pump 100 comprises a substantially cylindrical casing 101, having a first portion 102 and a second portion 103, coaxial to the former and with a smaller cross-section.

The first portion 102 houses the gas pumping stages and is provided with an axial suction port 119 at one end and a radial exhaust port 120 at the opposed end, while the second portion 103 houses the motor and the support bearings for the shaft of the turbomolecular pump 100.

A plurality of annular grooves 104 defining a series of cooling fins or rings 105 is provided on the outer surface of the first larger portion 102 of the casing 101.

Additionally, on the outer surface of said first larger portion 102 of the casing 101 there are formed three longitudinal grooves 106, spaced by 120° and adapted to allow the fitting of as many fastening screws 107 for securing the cylindrical casing 101 to the electronic control unit 1.

Annular grooves 108, defining a series of cooling rings 109 are also provided on the outer surface of the second smaller portion 103 of the casing 101.

The turbomolecular pump 100 is further provided with an annular protruding ring or flange 110 with peripherally spaced holes 117 for securing the turbomolecular pump 100 to the vessel or chamber (not shown) in which vacuum is to be created.

On the side opposed with respect to the flange 110, in correspondence of the basis of said second smaller portion 103 of the casing 101, there is provided a cylindrical extension 118 due to the presence within the pump 100 of the bearings and the motor.

Still with reference to the FIG. 9, the turbomolecular pump 100 comprises a monolithic rotor 112 in which there are formed rotor disks 113 having flat surfaces and rotor disks 114 equipped with blades.

The rotor disks 113 and 114 are radially located inside stator rings 115 and 116, respectively, for forming pumping channels for the gases.

With reference again to FIGS. 4 to 8, the electronic control unit 1 comprises a housing 2 having a lower resting surface 3, an upper closure surface 4, and side walls 5 and 6.

The side wall 6 comprises a rounded portion 12 and two linear portions 13, substantially parallel to each other.

The upper closure surface 4 is provided with a circular opening 16 for the passage of the second portion 103 of the cylindrical casing 101.

The second portion 103 is therefore completely housed inside the space provided in the housing 2, while the first portion 102 of said cylindrical casing 101 is outside the housing 2.

In the rounded portion 12 of the side wall 6 there are provided a plurality of slots 9 whereas on the substantially opposed side wall 5 of the housing 2 there is provided an opening 7, covered by a net or grid 8. A cooling air flow enters the housing 2 through the slots 9, passes through the housing 2 and comes out through the opening 7.

In the side wall 5 there are further provided a removable cap 10 for accessing to a device safety fuse (not shown), a sealing ring 11 for the passage of the supply cable 50 comprising a plurality of leads to the electronic control unit 1, and connectors 51, 52 and 53 for the communication and the control of unit 1 by means of an external unit (not shown), if required.

Figure 7:
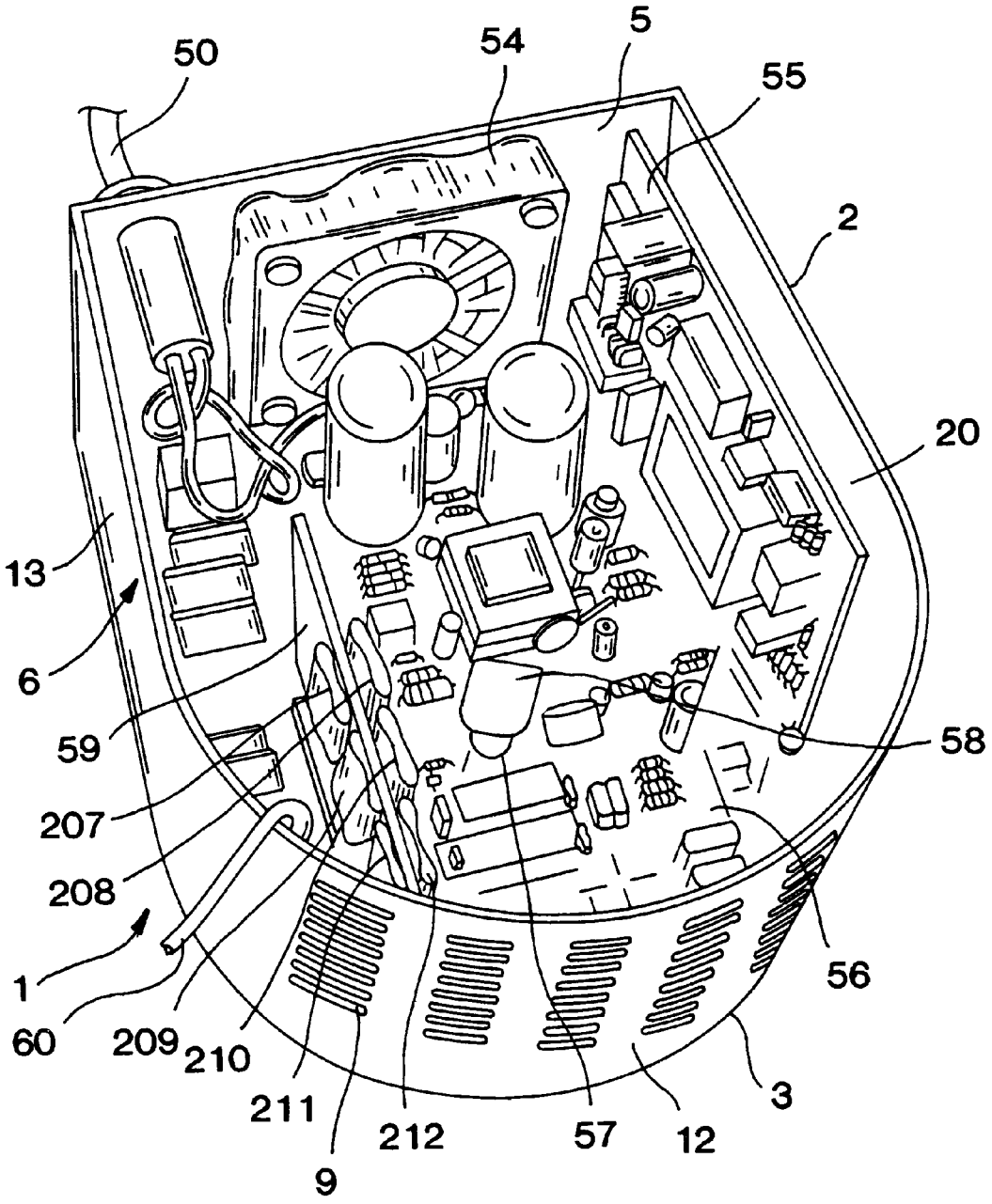
FIG. 7 is a top perspective view of the electronic control unit according to the invention, shown in the open condition.

The electronic control unit 1 further comprises leads 60 as shown in FIG. 7 for feeding the three-phase asynchronous motor of the vacuum pump 100.

The air flow passing through the housing 2 is obtained through a cooling fan 54 located internally to the housing 2, in correspondence of the opening 7 in the side wall 5.

Inside the housing 2 there are further housed the electronic components of the electronic control unit 1.

More particularly, in order to house all the electronic components in the housing 2, most of such components are substantially carried by two main (printed circuit) boards 56 and 55, the first one being disposed on the bottom of the housing 2 and parallel to the lower resting surface 3, and the second one being adjacent and parallel to one of the straight portions 13 of the side wall 6.

A thermistor 57 is mounted on the board 56, substantially positioned at the center of the lower circular opening 16 of the housing 2 for the passage of the second portion 103 of the cylindrical casing 101, with the surface of the thermistor 57 substantially in contact with the cylindrical extension 118, i.e. the extension due to the presence, inside the pump 100, of the bearings and of the pump motor, when the pump 100 is fitted into the housing 2.

In order to improve the thermal contact between the surface of the thermistor 57 and the cylindrical extension 118, a resin layer 58 is interposed between the surface of the thermistor 57 and the cylindrical extension 118.

A metal plate 59 is further provided inside the housing 2, parallel to one of the straight portion 13 of the side wall 6, opposed to the board 55 with respect to the thermistor 57.

The function of the metal plate 59 is to act as a heat sink of the heat generated by the six MOSFET transistors 207 through 212 that are mounted on both surfaces of said metal plate 59 and in thermal contact therewith. The plate is located in a space subjected to the flow of cooling air entering through the slots 9 of the housing 2 and coming out from the opening 7 on the opposed side of the housing 2.

Therefore this air flow cools both the cooling rings 109 formed in the second portion 103 of the casing 101 of the pump 100 housed in said housing 2, and the electronic components of the electronic control unit 1.

Due to the position of the thermistor 57 with respect to the three pairs of power dissipating components formed by the MOSFET transistors 207 through 212 and to the portion of the vacuum pump housing pump components that are at the highest temperature, only a single thermistor is used for controlling the temperatures of the pump and of the most critical electronic components of the electronic control unit 1.

The temperature of the MOSFET transistors 207 through 212 is directly measured through the value of electric resistance of the thermistor 57 that is related to the average temperature between the pump and the MOSFET transistors.

On the other hand, a measure of the temperature of the pump bearings is obtained by combining the temperature information supplied by the thermistor 57 with the information relating to the power absorbed by the pump, by using the following relationship:

$$T_{bearings}=T_t+K\cdot W$$

where W is the mean power absorbed by the pump that is calculated in a variable time duration as a function of the thermal time constant of the pump, K is a constant depending on the components used, and Tt is the thermistor temperature.

Figure 8:
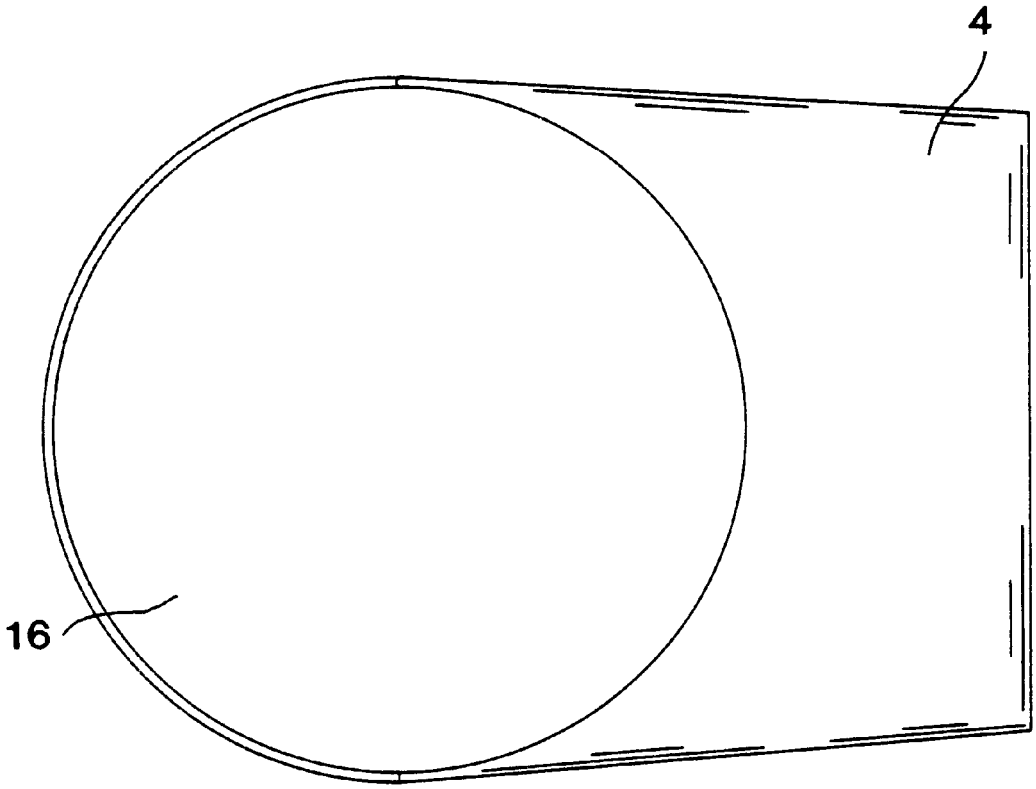
FIG. 8 is a plan view of the case housing the electronic control unit of the present invention.

As better shown in the plane view of FIG. 8 the casing 2 of the electronic control unit 1 has a substantially rounded shape and is substantially contained within the overall dimensions of the turbomolecular pump 100.

Thus the device integrating both the turbomolecular pump 100 and the electronic control unit 1 has reduced dimensions with respect to the traditional arrangements in which the pump and the control unit are provided as separate devices.

An additional advantage of integrating the electronic control unit in the turbomolecular pump is that the same air flow passing through the housing 2 for cooling the electronic circuits housed inside the housing 2, can be used for cooling the second lower portion 103.

Further by integrating the control unit 1 with the turbomolecular pump 100 the length of the feeding leads 60 located between the feeding electronic unit and the turbomolecular pump 100 is reduced to a minimum.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electronic control unit for an electric motor of a vacuum pump, said unit comprising:

a first plurality of leads for electrically feeding said control unit;

a second plurality of leads comprising a voltage system for electrically feeding said electric motor of the vacuum pump;

a circuit interconnected between said first plurality of leads and said second plurality of leads for generating a voltage for feeding said electric motor of the vacuum pump under control of a plurality of pulsating drive signals providing at least one pulsating signal, having the pulse width and capable of being modulated, said circuit comprising:

a microprocessor generating said at least one pulsating signal and said plurality of pulsating drive signals (A, B, D, E, G, H) controlling, through gate driver circuits, a plurality of discrete power components, each comprising a pair of MOSFET transistors for each voltage;

means for combining said at least one pulsating signal (PWM) with at least another one of said pulsating drive signals in said circuit and modifying the rms voltage of at least one voltage of said voltage system proportionally to the width of said modulated pulsating signal, said combining means comprises a plurality of logic gates, said at least one pulsating signal being applied to a first input of each logic gate, and one of said pulsating drive signals being applied to a second input of a corresponding one of said logic gates, whereby said logic gates periodically interrupt/activate said at least one pulsating drive signal in correspondence with the pulses of said at least one pulsating signal; and a housing for disposing said first and second plurality of leads and said circuit, said housing enclosing a lower portion of the vacuum pump with said electric motor disposed therein.

2. The electronic control unit of claim 1, wherein said logic gates are NOR logic gates.

3. The electronic control unit of claim 1, wherein at least one of said MOSFET transistors in each pair of MOSFET transistors is driven by one of the drive signals that is generated by said microprocessor and periodically interrupted-activated in correspondence with HIGH/LOW states of said pulsating signal.

4. The electronic control unit of claim 1, wherein said electric motor is a polyphase asynchronous motor, and wherein said voltage adapted to feed the motor of the vacuum pump is a square wave polyphase voltage.

5. The electronic control unit of claim 1, wherein said electric motor is a D.C. brushless motor, and wherein said voltage system adapted to feed the motor of the vacuum pump is a square wave polyphase voltage.

6. The electronic control unit of claim 1, wherein said electric motor is a switched reluctance motor, and wherein said voltage adapted to feed the motor of the vacuum pump is a square wave polyphase voltage.

7. The electronic control unit of claim 4, wherein the frequency of said pulsating signal is within the range of 5 and 20 times the excitation frequency of said polyphase asynchronous motor.

8. The electronic control unit of claim 5, wherein the frequency of said pulsating signal varies as a function of the rotor position in said electric motor of the vacuum pump, the information relating the rotor position being supplied to the microprocessor by a position sensor incorporated in said electric motor.

9. The electronic control unit of claim 6, wherein the frequency of said pulsating signal varies as a function of the rotor position in said electric motor of the vacuum pump, the information relating the rotor position being supplied to the microprocessor by a position sensor incorporated in said electric motor.

10. An electronic control unit of claim 1, further comprising a fan for generating a flow of cooling air within said housing.

11. An electronic control unit of claim 10, wherein said housing further comprises a first plurality of inlet openings for entering air sucked by said fan and an opening for exiting air blown by said fan, said plurality of inlet openings and said outlet opening being located on reciprocally opposed sides of said housing.

12. An electronic control unit of claim 1, further comprising a metal plate, said plate being a heat sink cooperating with the air flow generated by said fan for dissipating the heat generated by said discrete power components, said discrete power components being disposed in thermal contact with both surfaces of said metal plate.

13. An electronic control unit of claim 1, further comprising a thermistor for sensing the temperatures of said pump and of said discrete power components inside said housing, said thermistor disposed within said casing in contact with said lower portion of said pump body of the vacuum pump.

14. The electronic control unit of claim 13, wherein the value of an electric resistance of said thermistor is proportional to the mean value between the temperatures of the support bearings of said vacuum pump and said discrete power components.

* * * * *